United States Patent [19]

Suttles

[11] 4,423,816

[45] Jan. 3, 1984

[54] FORWARD FEED MERCHANDISING DEVICE FOR SOFT DRINK BOTTLES

[75] Inventor: James M. Suttles, Elberton, Ga.

[73] Assignee: The Mead Corporation, Atlanta, Ga.

[21] Appl. No.: 424,148

[22] Filed: Sep. 27, 1982

Related U.S. Application Data

[62] Division of Ser. No. 178,933, Aug. 18, 1980, Pat. No. 4,367,818.

[51] Int. Cl.[3] ..... A47F 5/00

[52] U.S. Cl. ..... 211/183; 193/38; 211/49 D

[58] Field of Search ..... 211/49 D, 74, 162, 183; 294/87.28; 312/45, 42; 193/38, 2 R

[56] References Cited

U.S. PATENT DOCUMENTS

| | | | |
|---|---|---|---|
| 2,620,691 | 12/1952 | Gould . | |
| 2,919,814 | 1/1960 | Berkowitz | 211/74 |
| 3,243,220 | 3/1966 | Karas . | |
| 3,553,927 | 1/1971 | Anglade . | |
| 4,310,097 | 1/1982 | Mere | 211/74 X |
| 4,318,485 | 3/1982 | Clement | 211/74 X |

*Primary Examiner*—Ramon S. Britts
*Assistant Examiner*—Robert W. Gibson, Jr.
*Attorney, Agent, or Firm*—Howson and Howson

[57] ABSTRACT

In a gravity-operated, forward feed bottle merchandiser, bottles are supported by their necks on tracks consisting of parallel track elements which are removable and reversible to accommodate bottles of different neck widths. Each track element is secured between front and rear support rails. The track elements are held against rotation in slots in the rear support rail, and must be twisted in order to be disengaged from the front support rails.

Each track element comprises a web having flanges extending in opposite directions respectively from its upper and lower edges. Ramps extending forwardly from the flanges cross each other and each ramp has a projection overlying the other ramp so that the ramps reinforce each other.

1 Claim, 10 Drawing Figures

FORWARD FEED MERCHANDISING DEVICE FOR SOFT DRINK BOTTLES

This application is a division of application Ser. No. 178,933, filed Aug. 18, 1980 now U.S. Pat. No. 4,367,818.

BRIEF SUMMARY OF THE INVENTION

This invention relates to forward feed merchandising devices for soft drink bottles. It relates particularly to improvements in gravity-feed merchandising devices in which soft drink bottles are suspended by their necks and carried forward by gravity on an inclined track, and in which the track comprises a pair of elongated track elements, at least one of which is adapted to be supported in at least two alternative positions so that bottles having different neck widths can be accommodated.

One form of soft drink bottle merchandising device of the neck suspension type is described in the copending application of Joseph J. Clement, Ser. No. 109,061, filed Jan. 2, 1980, now U.S. Pat. No. 4,318,485. The Clement apparatus takes advantage of the fact that soft drink bottles, as current manufactured, have externally projecting neck rings. Each of its tracks comprises a pair of substantially parallel, upwardly facing supporting surfaces with opposed edges spaced from each other to form an elongated slot of substantially uniform width. The necks of the bottles extend through the slot, and the neck rings rest on the upwardly facing support surfaces. In the Clement apparatus, the major portion of the track is inclined downwardly to effect feeding by gravity, while the forward end of the track is inclined upwardly in order to cause the bottles to come to a gradual stop at the forward end of the track.

Soft drink bottles are currently available in two standard sizes, namely 28 mm. and 38 mm., these dimensions referring to neck diameters. It is desirable to provide the merchandising device with a convertibility feature so that either bottle size can be accommodated.

In the Clement apparatus, convertibility is achieved in one or the other of two ways. The first is to provide detachable plastic strips which can be pressed onto the opposed edges of a track to reduce the width of the track slot. The other is to provide a multiple track unit which has tracks on the bottom and tracks on the top, and which can be turned upsidedown to change the slot width of the tracks which are in use. The former solution requires auxiliary parts, and the latter solution results in a track unit which is heavy and which takes up excessive vertical space.

Another system is described in my copending application, Ser. No. 116,977, filed Jan. 30, 1980. In my application, I described a merchandising device in which each track comprises at least one elongated element having a web with parallel edges extending in the direction of its length. A first flange extends in one direction substantially perpendicularly from one of the parallel edges, and a second flange extends in the opposite direction substantially perpendicularly from the other of the parallel edges. The flanges are of different widths transverse to the direction of elongation. The track supporting means includes means for supporting the elongated element in a first position in which its first flange serves as one of two substantially parallel supporting surfaces and alternatively in a second position in which its second flange serves as one of the parallel supporting surfaces. By reversing the track element, the slot size can be changed, and bottles having different neck widths can be accommodated.

In the device described in my copending application, the track elements are suspended between forward and rearward transverse support rails, which are substantially identical to each other. The track elements are supported by engagement with slots in the support rails. These slots have a complex shape, which is such as to prevent the track elements from rotating beyond certain established limits in directions such that the track slot widens. The track elements, however, can be rotated in the opposite direction for removal. So long as bottles are present in the tracks, the track elements cannot be removed. However, a problem arises when a particular track has no bottles in it. The elements of that track can be easily knocked loose, and may fall away from the supporting frame. This is particularly likely to occur in reloading, and it can also occur by accident when a customer is removing the last bottle from a track.

One object of this invention is to improve the merchandising device of my copending application so that its track elements cannot be accidentally knocked loose by store personnel or by customers.

It is also an object of the invention to provide a removable track element which is securely held in place, which is simple in construction, which requires no extra parts, which is inexpensive, and which can be easily moved from one position to another so that the track can be converted to accommodate bottles having different neck widths.

The foregoing objects are achieved by using a modified rear support rail. The rear support rail is removably engageable by a rear portion of the elongated track element. It prevents lateral translation of the rear portion of the track element and also prevents rotation of the rear portion of the track element relative to the rear support rail. To remove the track element, its forward end is twisted so that it can be disengaged from the forward rail. Resilient means are provided for resisting this twisting movement. Preferably, the resilient means is constituted by that portion of the track element which extends between the front and rear rails. Accordingly, the track element is made of sufficiently light gauge sheet metal to allow the track element to be twisted manually to an extent sufficient to effect disengagement of the track element from the front support rail.

Each of the track elements of my copending application comprises a web having oppositely projecting flanges on the opposite edges of the web, and oppositely extending ramps at least at one end. The purpose of these ramps is to retard the forward movement of the column of bottles held in the track. In practice, unless very heavy gauge sheet metal is used for the track elements, the ramps are insufficiently stiff, and are susceptible to bending under the weight of the bottles. Consequently, they are reinforced by welding them to the web of the track element. Welding of the ramps is a time-consuming and expensive step in the manufacturing process.

Another object of this invention, therefore, is to eliminate the need for welding the ramps to the web, while enabling light gauge sheet metal to be used in forming the track elements. This object is achieved by providing, at one end of the track element, first and second ramps, which extend, in a forward direction, respectively from the ends of the oppositely projecting flanges of the track element. These ramps are in perpendicular relationship to the plane of the web, and in oblique relationship to the track element flanges. They extend beyond one end of the web, and cross each other. Each ramp has means projecting through the plane of the web and overlying and engaging the other ramp, for preventing the other ramp from bending toward a coplanar relationship with the flange from which it extends. Thus, the ramps, unlike those in my copending application, extend beyond the end of the web and interlock with each other so that the weight of the bottles on the ramps cannot cause them to deform. The need for a welding step is completely eliminated, and the track elements can be made from a unitary piece of sheet metal which is of sufficiently light gauge to permit the twisting action needed in order to engage the track element with and disengage it from its support.

Further objects will be apparent from the following detailed description when read in conjunction with the drawings.

DETAILED DESCRIPTION

Figure 1:
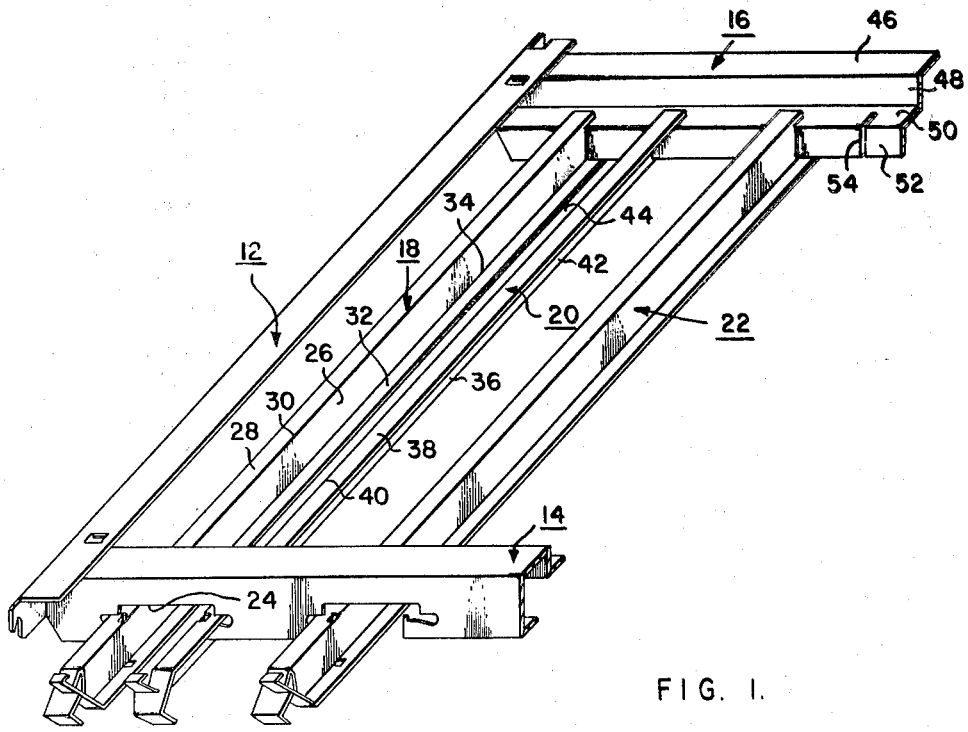
FIG. 1 is an oblique perspective view showing a portion of a track support unit, with two track elements forming a first track, and a third track element forming a part of a second track.

A beverage display stand or "merchandiser" in accordance with the invention comprises one or more track support units of the kind shown in FIG. 1, removably supported on a rack (not shown). The rack can be conventional four-post rack or alternatively a rack consisting of a base having a vertically extending back wall on which the track support units are cantilevered. In general, each merchandiser will have several track support units arranged one above another.

The track support unit of FIG. 1 is designed for use in a four-post rack. It is formed entirely of sheet metal, and comprises a side member 12, front and rear track support rails 14 and 16, and a side member (not shown) parallel to member 12 and at the opposite ends of the rails from member 12. Only one such track is shown in full, and comprises track members 18 and 20. A typical track support unit has four tracks, i.e. four pairs of track members. One additional track member is shown in FIG. 1 at 22.

Track members 18 and 20 are secured to front support rail 14 in a specially formed slot 24, which will be described in detail with reference to FIGS. 2–5. Track member 18 comprises a substantially planar web 26 having a flange 28 extending perpendicularly to the web from the web's upper edge 30, and a flange 32 extending perpendicularly from the web in the opposite direction from its lower edge 34.

Track element 20 is similar to element 18, and comprises a web 36, a flange 38 extending perpendicularly from upper edge 40 of the web, and a lower flange (not seen in FIG. 1) extending in the opposite direction from lower edge 42 of web 36. The lower flanges, namely flange 32 and its counterpart on track element 20, provide a slot 44 for receiving the necks of bottles supported in the track. The neck rings of the bottles rest on the inwardly projecting flanges of the track.

Flange 32 and its counterpart on element 20 are narrower than upper flanges 28 and 30. Thus, a relatively wide slot is provided at 44. Elements 18 and 20 can be turned upside-down so that wide flanges 28 and 38 oppose each other to form a narrower slot.

Typically, flanges 28 and 38 are of equal width, and the width of flange 32 is equal to the width of its counterpart on element 20. In the position of the track elements shown in FIG. 1, the slot is adapted for handling bottles having a 38 mm. neck diameter. For 28 mm. bottles, both track elements are turned upside-down. An intermediate size can be accommodated by turning only one of the track elements upside-down. If desired, a total of four different bottle neck sizes can be accommodated by modifying the width of one of the flanges of one of the track elements.

Rear support rail 16 has a W-shaped cross-section as shown in FIG. 1, and comprises a rearwardly extending flange 46, a first web section 48 extending perpendicularly downwardly from the forward edge of flange 46, a second web section 50 extending forwardly from the lower edge of web section 48, and a flange 52 extending perpendicularly downwardly from the forward edge of web section 50. Rear rail 16 is secured to side member 12 and the opposite side member (not shown) by spot welds or other suitable means. Front support rail 14 is similarly secured to the side members so that a rigid framework structure is formed.

Web section 50 of rear support rail 16 and depending flange 52 are provided with a series of slots, one such slot being shown at 54. Each slot extends through the entire vertical height of flange 52, and rearwardly from the front edge to an intermediate location in web section 50. These slots receive the webs of the track elements, as shown in FIG. 1. Preferably, the height of flange 52 is such that its lower edge is contacted by the lower flanges of the track elements, while web section 50 is contacted by the upper track element flanges. Thus, when the web of a track element is inserted in a slot, the rear portion of the track element is prevented from vertical translation. The engagement of the slot edges with the web itself prevents horizontal translation. Rotation of the rear portion of each track element relative to rear support rail 16 is prevented by the engagement of the track element web in its slot. The engagement of the track element flanges with web section 50 and with the lower edge of flange 52 aids the slot in preventing rotation of the rear portion of each track element in at least one direction.

Figure 5:
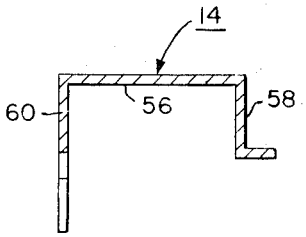
FIG. 5 is a section of the front support rail of the track support unit taken on a vertical plane parallel to the direction of track elongation.

Front rail 14 is shown in cross-section in FIG. 5. It comprises a horizontal web 56 for attachment to the side elements, a rear, L-shaped reinforcing flange 58, and a depending front flange 60. As shown in FIG. 1, flange 60 of element 14 is provided with a series of evenly spaced slots of complex shape, corresponding to slot 24.

Figure 4:
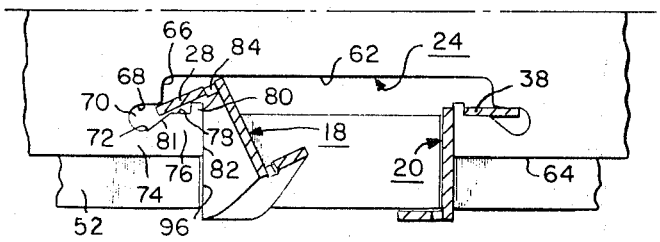
FIG. 4 is a transverse section of a track showing the manner in which a track element is twisted for insertion and removal.

The complex shape of the slots is best seen in FIG. 4, which shows the details of slot 24. Slot 24 comprises a horizontal edge 62 which is parallel to and spaced upwardly from lower edge 64 of flange 60. At the left-hand end of the slot, the edge of flange 60 curves downwardly at 66 to meet another horizontal, downwardly facing edge 68, which is positioned at a level below edge 62. Horizontal edge 68 is the upper boundary of an opening 70, the lower boundary of which, at 72, is the upper edge of a horizontal extension 74. At the right-hand end of horizontal extension 74, there is provided an upwardly projecting vertical extension 76 having a horizontal upper edge 78 and an upwardly extending tab 80.

Preferably, the left-hand edge 81 of extension 76 extends obliquely from lower boundary 72 of opening 70 to horizontal edge 78. Horizontal edge 78 is positioned at a level below the level of downwardly facing edge 68, the vertical spacing between these two edges being equal to the thickness of the sheet metal from which the track elements are made. Opening 70 should be large enough to provide clearance for the larger of the two track element flanges.

The configuration of the right-hand end of slot 24 is a mirror image of the configuration of the left-hand end, and need not be separately described.

Figure 2:
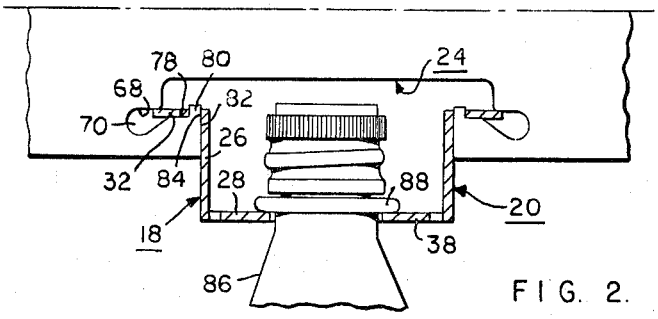
FIG. 2 is a transverse section of a track showing the manner in which the track members cooperate with a front support and with a bottle having a small neck diameter.

In FIG. 2, track element 18 is installed in slot 24 with its narrower flange 32 extending into opening 70 and resting on horizontal edge 78. Flange 32 also engages downwardly facing edge 68, and web 26 engages the vertical right-hand edge 82 of horizontal extension 74. Tab 80 projects upwardly through an opening 84 formed in flange 32. The opposite track element 20 is similarly installed at the opposite side of slot 24. The neck of bottle 86 extends through the slot formed by the opposed edges of flanges 28 and 38, and these flanges engage the underside of neck ring 88 to support the bottle.

Track element 18 cannot rotate clockwise beyond the position in which it is shown in FIG. 2, since web 26 is engaged with edge 82. So long as the front portion of track element 18 is maintained in this position it is locked against vertical translation by the engagement of flange 32 with slot edges 68 and 78 and against horizontal translation by the engagement of tab 8 with opening 84 and by the engagement of web 26 with edge 82. Thus, the front portion of the track element is locked against lateral translation in all directions. The engagement of tab 80 with opening 84 also locks the track element against longitudinal translation. Track element 20 is similarly locked against lateral and longitudinal translation.

The front portions of the track elements are held in the positions shown in FIG. 2 so long as a bottle is present in the slot formed by the opposed edges of flanges 28 and 38.

Figure 3:
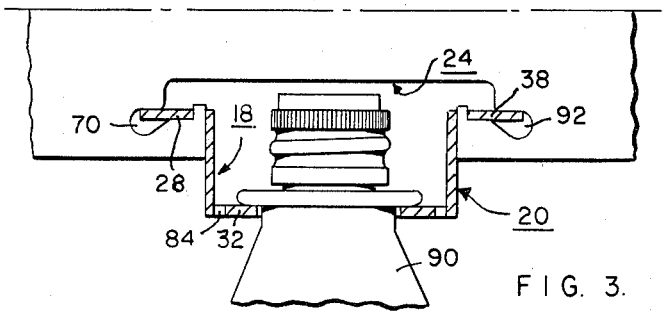
FIG. 3 is a transverse section, similar to FIG. 2, in which the track elements are reversed in order to accommodate a bottle having a larger neck diameter.

In FIG. 3, the track elements are reversed in order to provide a wider slot to accommodate the wider neck of bottle 90. Opening 70 and its counterpart 92 at the opposite end of slot 24 are made sufficiently deep to accommodate wide flanges 28 and 38.

The track elements are removed and replaced in the manner shown in FIG. 4. While the rear end of element 18 remains engaged with slot 96 in flange 52, the front portion of the element is rotated counterclockwise so that opening 84 becomes disengaged from tab 80. The track element can then be pulled forward so that its rear end is disengaged from slot 96. The track element can then be removed.

Installation is accomplished by first inserting the rear end of the track element in slot 96. The front position of the track element is then rotated counterclockwise and its flange 28 is caused to enter opening 70. Opening 84 is positioned over tab 80, and the tortion on the intermediate portion of the element is released. Opening 84 is engaged with tab 80, and the element is locked in place.

Because the track elements are resilient and must be twisted in order to be released, the track elements cannot be accidentally jarred loose from the track support unit.

Alternative means can be used for resisting rotation of the front portions of the track elements. For example, the slots on the rear support rail could be provided with springloaded rotatable panels which rotate when tortional forces are applied to the front ends of the track elements. However, the much simpler, and preferred means for resisting rotation of the front portion of a track element is the resilient intermediate portion of the track element itself.

Figure 6:
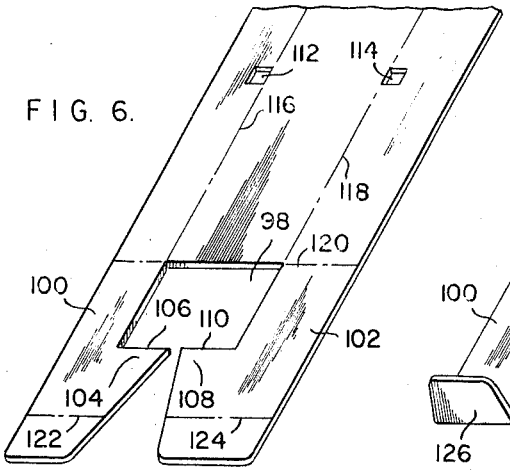
FIGS. 6–10 are oblique perspective views showing the successive steps in the formation of a track element, and showing the manner in which the ramps are interlocked with each other.

A track element in accordance with the invention is made by punching openings in a flat, substantially rectangular sheet metal blank, as shown in FIG. 6. A first rectangular opening 98 is formed near one end of the blank. Opening 98 is assymetrically disposed with respect to the long edges of the blank, that is, it is nearer one long edge than the opposite long edge. Thus two forwardly extending projections 100 and 102 are formed, the latter being wider than the former. Projection 100 is formed with an inwardly projecting section 104 having an edge 106 which is perpendicular to the long edges of the blank. Section 102 similarly has an inward projection 108 having an edge 110 which is in line with edge 106. Sections 104 and 108 do not touch, but have a small, preferably wedge-shaped, space between them. Small rectangular openings 112 and 114 are also formed in the blank. These latter openings are for receiving retaining tabs of the front support rail.

In FIG. 6, fold lines are shown at 116, 118, 120, 122 and 124. Fold line 116 is parallel to the left-hand edge of the blank, and in line with the left-hand edge of opening 98. Fold line 118 is in line with the right-hand edge of opening 98. Fold line 120 is in line with the upper edge of rectangular opening 98.

Figure 7:
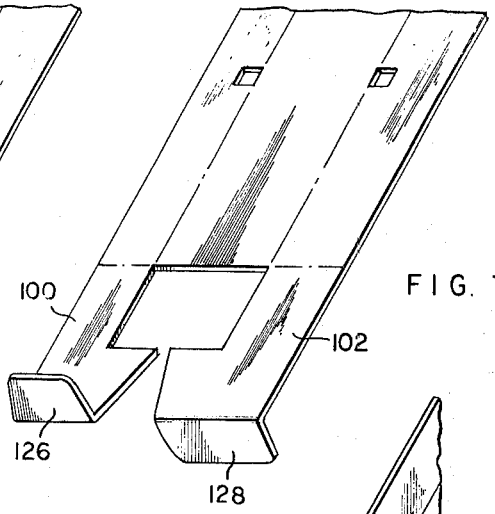

The next step in the formation of the track element is to bend the blank at lines 122 and 124 to form flanges 126 and 128, which extend in opposite directions from the plane of the blank, as shown in FIG. 7. (These flanges serve to prevent bottles from sliding up and off the ramps at the forward ends of the tracks. They require the customer to lift the foremost bottle on a track upwardly in order to remove it.)

Figure 8:
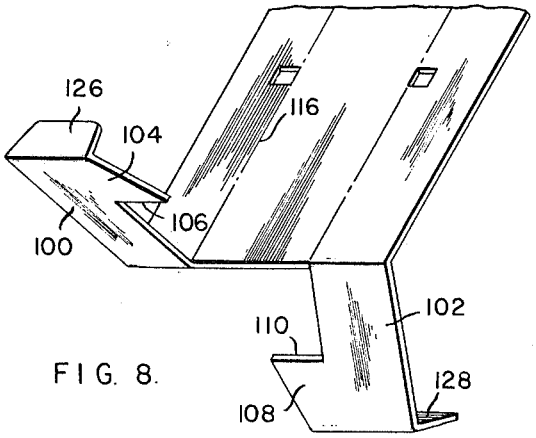

To form the ramps, projections 100 and 102 are then bent, along fold line 120, in opposite directions with respect to the plane of the blank, as shown in FIG. 8. These projections are preferably bent until they form angles about 135 degrees with respect to the plane of the blank.

Figure 9:
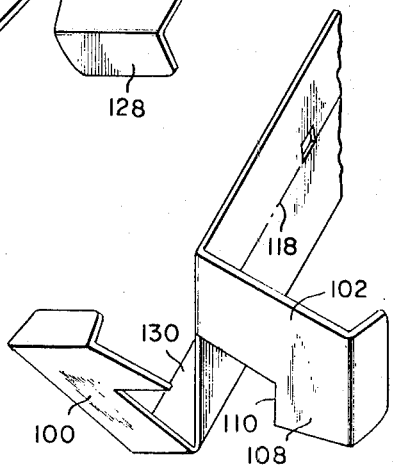

The blank is then folded along line 116, as shown in FIG. 9 to provide a flange 130, which is perpendicular to the main portion of the blank.

Figure 10:
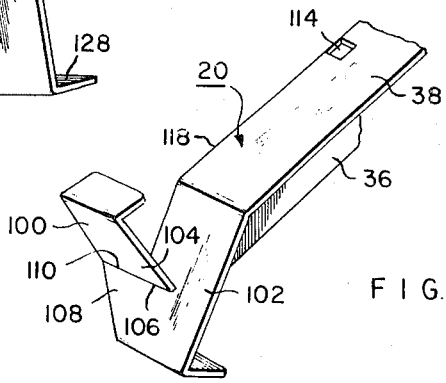

Finally, the blank is bent along fold line 118 to form a perpendicular flange 38, as shown in FIG. 10. Flange 38 is parallel to flange 130, and perpendicular to web 36, by which flanges 38 and 130 are connected. Section 106 projects through the plane in which the web lies.

The final fold along line 118 causes section 104 to project through the plane of web 36. Edge 110 of projection 108 engages projection 100, and edge 106 of projection 104 engages projection 102. Projections 100 and 102 provide the ramps of the track element. The ramps mutually reinforce each other so that the weight of a bottle on either ramp cannot cause it to bend.

As will be apparent from FIGS. 6-10, the formation of the track element involves a simple and straightforward sequence of steps, which can be carried out rapidly, especially since no welds and fasteners are required. The mutual reinforcement of the ramps produces a track element having a high degree of strength, which is more than adequate for the purpose of accommodating bottles in a forward feed track. Of particular significance is the fact that mutual reinforcement of the ramps allows the track elements to be made from light gauge sheet metal so that they can be twisted for removal and replacement in the support unit.

I claim:

1. A unitary, elongated sheet metal track element for use in a bottle merchandising device comprising:

a substantially planar, elongated web having two opposite edges extending in the direction of its length; and first and second flanges of different widths extending in opposite directions from the respective edges of said web in substantially perpendicular relationship to said web;

and characterized by first and second ramps, extending respectively from said first and second flanges, in perpendicular relationship to the plane of said web and in oblique relationship to said flanges, beyond one end of said web, said ramps crossing each other, and each ramp having means, projecting through the plane of said web and overlying and engaging the other ramp, for preventing said other ramp from bending toward a coplanar relationship with the flange from which it extends.

* * * * *